US005435024A

United States Patent [19]

Capshaw

[11] Patent Number: 5,435,024

[45] Date of Patent: Jul. 25, 1995

[54] GROUND COVER WITH COLLAPSIBLE FRAME

[76] Inventor: Angela Capshaw, 30041 Tessier St. Ste 179, Laguna Niguel, Calif. 92677

[21] Appl. No.: 167,552

[22] Filed: Dec. 13, 1993

[51] Int. Cl.[6] ..... A47G 9/06

[52] U.S. Cl. ..... 5/417; 135/127; 135/139; 135/141

[58] Field of Search ..... 5/417–420; 52/3; 135/139, 141, 127, 114, 116

[56] References Cited

U.S. PATENT DOCUMENTS

| | | | |
|---|---|---|---|
| Re. 28,067 | 7/1974 | Hyman | 135/114 |
| 3,114,376 | 12/1963 | Rexroat et al. | 135/116 |
| 3,494,658 | 2/1970 | Maes | 296/100 |
| 4,590,956 | 5/1986 | Griesenbeck | 135/116 |
| 4,794,029 | 12/1988 | Tennant et al. | 5/417 |
| 4,991,978 | 2/1991 | Ostrowski | 5/417 |
| 5,059,463 | 10/1991 | Peters | 5/417 |
| 5,074,014 | 12/1991 | Freeman | 24/714.6 |
| 5,168,605 | 12/1992 | Bartlett | 24/519 |
| 5,206,964 | 5/1993 | Wilson, Sr. | 5/420 |
| 5,232,005 | 8/1993 | Mitchell | 135/88 |
| 5,238,015 | 8/1993 | Gretzmacher et al. | 135/114 |

*Primary Examiner*—Alexander Grosz
*Attorney, Agent, or Firm*—Robert Samuel Smith

[57] ABSTRACT

A ground cover such as for use at the beach for picnics or sunbathing including a frame being a plurality of tube sections, each tube section having one end with a smaller diameter than another end of said tube section such that said smaller end of each tube is insertable into said larger end of a neighboring tube. The tube sections have arcuate shapes and each tubular section has ends joinable to ends of neighboring tubular sections to form a continuous frame. A flexible sheet cover has an elastic band around its perimeter providing that the cover be attachable to the frame when the frame is in its assembeled condition.

12 Claims, 1 Drawing Sheet

FIG. 1
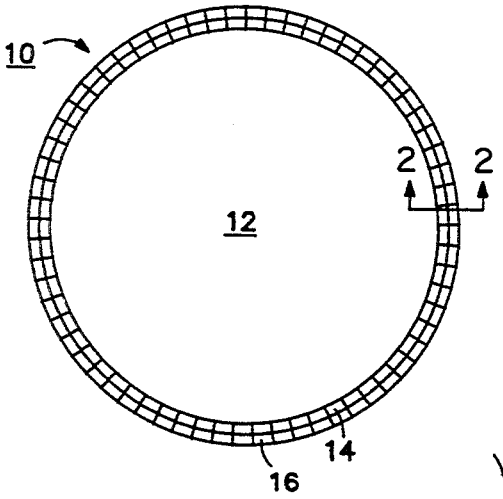
FIG. 2
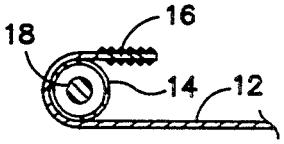
FIG. 3
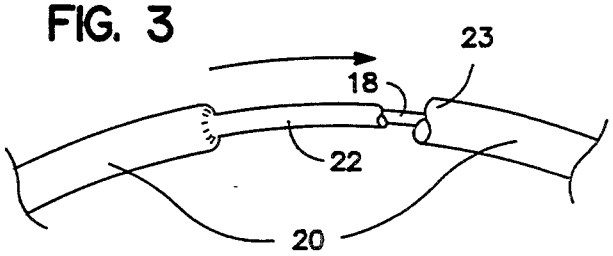
FIG. 4
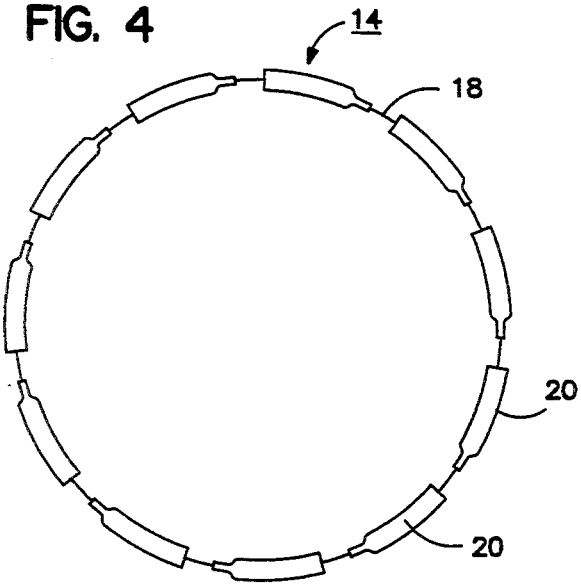
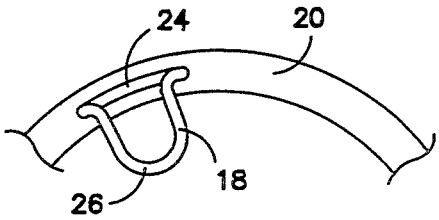
FIG. 5
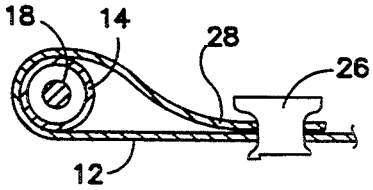
FIG. 6

GROUND COVER WITH COLLAPSIBLE FRAME

BACKGROUND

1. Field of the Invention

This invention relates to ground covers such as tarpaulins used for recreational purposes and particularly to a ground cover secured to a frame to be spread out on the beach for picnics, sunbathing, etc.

2. Prior Art and Information Disclosure

Covers such as tarpaulin's are used by the public to serve a number of purposes. These purposes include ground covers such as at the beach for picnics or sun bathing, covers for the beds of trucks to secure products, covers stretched over the decks of boats to provide a temporary shield to boaters, covers for goods stored out in the open where it is required to shield the goods from the weather.

A number of patents disclose devices for securing a tarp or cover as applied to particular situations.

U.S. Pat. No. 3,494658 to Maes discloses a fastening device for a tarp including an elongated element of resiliently flexible material and a pair of hooks adapted for attachment at one of a plurality of locations spaced along the tarp for securing the tarp to the bed of a truck.

U.S. Pat. No. 5,074,014 to Freeman discloses a tarp fastener being a button and roughly hairpin shaped wire retainer configured to grip the tarp at one of several locations.

U.S. Pat. No. 5,168,605 to Bartlett discloses an elastic cord having one end attached to a structural member and another end attached to a a planar clip having an elongated opening for detachable engagement with a button secured to the tarp.

Frames have been disclosed which are comprised of telescoping tubes. For example, U.S. Pat. No. 5,232,005 to Mitchell discloses a frame supporting a canopy for all riding lawn mowers having a frame for supporting a canopy that telescopes inside horizontal sleeves for adjustable positioning. The canopy is secured to the frame with snaps.

None of the constructions described suggests a construction which, in a disassembled condition, can be carried conveniently to a recreational area and be easily assembled and spread on the ground where it remains without "gathering" thereby providing a surface on which the user can comfortably sunbathe, have a picnic, etc.

THE INVENTION

Objects

It is an object of this invention to support a ground cover such that the cover does not become "gathered" thereby requiting frequent repositioning of the ground cover. It is contemplated to accomplish this object by providing a frame to which the outer edges of the cover are secured.

It is another object that the frame be easily assembled and disassembled and that the cover be easily attached and detached from the frame.

Summary

This invention is directed toward a cover stretched across and attached to a frame wherein the frame is a plurality of arcuate tubular sections joined end to end to form a hoop.

One end of each tube section telescopes into an end of a neighboring tube section so as to form a continuous frame. A cord is laced through the tubes so that the tubular sections may not be scattered from one another when the frame is disassembled. In one embodiment the cord is elastic so that the frame is held in its assembeled condition by the stretched elastic cord which is biased to prevent the tubes from separating from one another. In another embodiment, an opening in one of the tube sections permits the cord to serve as a drawstring in securing the ends of the tube sections to one another.

In one embodiment, the cover has an elastic band around its perimeter such that the band will "snap" over and around the frame thereby retaining the cover detachably secured to the frame. In another embodiment, the perimeter of the cover is buttoned to the frame.

BRIEF DESCRIPTION OF THE FIGURES:

FIG. 1 shows the assembled ground cover device of this invention.

FIG. 2 is a sectional view showing the attachment of the cover to the frame.

FIG. 3 shows details of the construction for joining the tube ends.

FIG. 4 shows the tube sections laced together.

FIG. 5 shows the construction in which the cord is a drawstring.

FIG. 6 shows the cover buttoned to the frame.

DESCRIPTION OF A PREFERRED EMBODIMENT:

The following description includes variations and modifications of the invention including what I presently believe to be the best mode for carrying out the invention.

Turning now to a discussion of the drawings, FIG. 1 shows the the assembled invention 10 including a cover stretched over a frame 14. Frame 14 is shielded from view in HG. 1 by the folded edge 16 of the cover 12. FIG. 2 is a sectional view taken along line of sight 22 in FIG. 1 and shows the cover 12 (cutaway) with elastic edge 16 stretched around tube section 14. FIG. 2 also shows in section a continuous cord 18 which is laced through all of the tube sections so as to prevent scattering of the tube sections when the frame is disassembled.

FIG. 4 shows the frame including a plurality of arcuate sections 20 disassembled but laced together by elastic cord 18 to prevent inadvertent scattering. The length of the elastic cord is selected such that, when the frame is assembled as shown in FIG. 1, the cord is stretch biased to hold the ends of each tube engaged with ends of the neighboring tubes.

FIG. 3 shows the construction for detachably engaging the neighboring ends of arcuate sections 20 and cord 18. One end 22 of one of said tubes has a diameter selected to permit insertion of the end of the tube into the end 23 of the neighboring tube.

FIG. 5 shows another embodiment of the invention for securing the frame in its assembled position and preventing scattering of the sections when the frame is disassembled. In this embodiment, the cord 18 is not elastic but a cutout 24 in one of the tube sections permits a loop 26 of the cord 18 to extend outside the tube so that the cord functions as a drawstring. When the tubes are all secured end to end, the loop is pulled further out of the opening 24 and tied.

FIG. 6 is a sectional view of yet another embodiment in which the lip 28 of the cover 12 is buttoned by button 26 to the frame 14.

The cover 12 may be formed from any one of a variety of materials such as canvas or rubberized fabric and is preferably water proof. The frame may be fabricated from any one of a number of materials such as plastic or aluminum tubes.

Other embodiments of the invention may be considered which are within the scope of the invention. For example, the frame need not be a ring but may have other shapes such as the shape of an oval or a rectangle. The cover may have pockets. I therefore wish to define the scope of my invention by the appended claims and in view of the specification if need be.

I claim:

1. A device for coveting an area of ground which comprises:

a frame being a plurality of tube sections, each tube section having one end with a smaller diameter than another end of said tube section such that said smaller end of each tube is insertable into said larger end of a neighboring tube;

said tube sections having arcuate shapes such that each said tubular section has both ends joinable to ends of neighboring tubular sections to form a continuous frame in an assembled condition being substantially flat and having a frame shape;

a flexible sheet cover having a perimeter with a shape and size substantially conforming to said frame shape and size of said frame when said frame is in said assembled condition;

means for detachably securing said perimeter of said flexible sheet cover to said frame.

2. A device as in claim 1 which comprises a cord laced through all of the tubes such as to prevent inadvertent scattering of the sections when the frame is disassembled.

3. A device as in claim 2 wherein said cord is elastic and has a length such that said elastic cord is stretch biased to maintain said frame in an assembled state with said ends of said tubular sections telescoped together.

4. A device as in claim 2 wherein one of said plurality of tube sections has an opening and a length of said cord extends through said opening away from said frame such that when said length is pulled and secured, said cord laced through said tubular sections is tightened thereby securing said frame in said assembled condition.

5. A device as in claim 1 wherein said means for detachably securing said perimeter of said sheet cover to said frame comprises an elastic band secured around said perimeter of said cover and having a length selected in operable combination with said size and shape of said frame such that said perimeter with said elastic band stretched over said frame detachably secures said sheet cover to said frame.

6. A device as in claim 1 wherein said shape of said frame is a circle.

7. A device as in claim 1 wherein said sheet cover has a plurality of button holes arranged proximal to said periphery and said means for securing said sheet cover to said frame is a plurality of buttons arranged in operable combination with said frame to detachably secure said perimeter of said sheet cover to said frame.

8. A device as in claim 1 wherein said tubular sections are aluminum.

9. A device as in claim 1 wherein said tubular sections are plastic.

10. A device as in claim 1 wherein said frame shape is a ring.

11. A device as in claim 1 wherein said sheet cover is waterproof.

12. A device as in claim 1 wherein said sheet cover is a fabric.

* * * * *